US006761355B1

(12) United States Patent
Lemieux

(10) Patent No.: US 6,761,355 B1
(45) Date of Patent: Jul. 13, 2004

(54) GAME APPARATUS AND METHOD

(76) Inventor: Mike J. Lemieux, 1023 Copleand Street, North Bay, ON (CA), P1B 3E7

( * ) Notice: Subject to any disclaimer, the term of this patent is extended or adjusted under 35 U.S.C. 154(b) by 0 days.

(21) Appl. No.: 10/266,209

(22) Filed: Oct. 7, 2002

(51) Int. Cl.[7] ..... A63F 3/00
(52) U.S. Cl. ..... 273/290; 273/126 R; 273/138.1
(58) Field of Search ..... 273/290, 126 R, 273/138.1, 144 A, 144 B, 144 R, 288, 153 P, 153 R, 157, 449, 450, 287, 291, 157 R; D21/385, 386, 390

(56) References Cited

U.S. PATENT DOCUMENTS 4,043,561 A * 8/1977 Stepansky ..... 273/153 P
5,054,789 A * 10/1991 Pellerin ..... 273/288

* cited by examiner

*Primary Examiner*—Vishu K. Mendiratta

(57) ABSTRACT

A new and improved game apparatus and method of using the game apparatus is disclosed. The game apparatus has a plurality of parts for use in betting and/or trading various parts of the game apparatus between players. The game apparatus comprises a plurality of sets of matching pieces, in which each piece within any given matching set has a geometric shape substantially matching all of the other pieces within the given matching set. Each piece also has an inside wall that defines a centrally disposed hole. Furthermore, each piece also has an sub-image embossed on at least one surface of each piece. Finally, each piece also has a logo marking marked on at least one surface of each piece. The method comprises the steps of obtaining, distributing, deciding, declaring, identifying, selecting, noting, determining, choosing, offering, accepting, attempting, winning, attaining, achieving, earning, getting, scoring, and transferring.

3 Claims, 3 Drawing Sheets

GAME APPARATUS AND METHOD

FIELD OF THE INVENTION

The present invention relates to games, more particularly to a game apparatus and a method of using the game apparatus for use in betting and/or trading various pieces of the game apparatus between the players.

DESCRIPTION OF THE PRIOR ART

Games of skill are desirable between two players because these games can be used to positively reinforce a mastery of the skills associated with playing these games. A wide variety of game apparatuses is currently available on the commercial market and an even larger number of these types of devices are known in the art of game apparatuses, for example, the board game having indicating playing pieces disclosed by Smith in U.S. Pat. No. 3,533,626; the game apparatus disclosed by Powell in U.S. Pat. No. 3,866,919; the game utilizing a chance selection device disclosed by Brotz in U.S. Pat. No. 5,524,896; the spinning disk game disclosed by Beck in U.S. Pat. No. 5,992,847; the ring-spinning games with game parts and methods of play disclosed by Escott and Escott in U.S. Pat. No. 6,182,965B1; and the game board disclosed by Alonco et al in U.S. Pat. No. D209,912.

While all of the above-described devices fulfill their respective, particular objectives and requirements, the aforementioned patents do not describe a game apparatus having pieces with an indicia affixed on each piece, a sub-image embossed on each piece and a logo marking marked on each piece. These elements makes it possible to allow the players to play with the various pieces of the game apparatus in a manner comprising the steps of obtaining, distributing, deciding, declaring, identifying, selecting, noting, determining, choosing, offering, accepting, attempting, winning, attaining, achieving, earning, getting, scoring, and transferring. The above-described patents make no provision for a game apparatus having pieces with an indicia affixed on each piece, a sub-image embossed on each piece and a logo marking marked on each piece.

Therefore, a need exist for a new and improved game apparatus that can be used for allowing the players to play with the various pieces of the game apparatus in a manner which comprising the steps of obtaining, distributing, deciding, declaring, identifying, selecting, noting, determining, choosing, offering, accepting, attempting, winning, attaining, achieving, earning, getting, scoring, and transferring. In this respect, the game apparatus according to the present invention substantially departs from the conventional concepts and designs of the prior art, and in doing so provides an apparatus primarily developed for the purpose of providing a game apparatus having pieces with an indicia affixed on each piece, a sub-image embossed on each piece and a logo marking marked on each piece.

SUMMARY OF THE INVENTION

The present device, according to the principles of the present invention, overcomes the shortcomings of the prior art by providing a new and improved game apparatus and method of using the game apparatus is disclosed. The game apparatus has a plurality of parts for use in betting and/or trading various parts of the game apparatus between players. The game apparatus comprises a plurality of sets of matching pieces, in which each piece within any given matching set has a geometric shape substantially matching all of the other pieces within the given matching set. Each piece also has an inside wall that defines a centrally disposed hole. Furthermore, each piece also has an sub-image embossed on at least one surface of each piece. Finally, each piece also has a logo marking marked on at least one surface of each piece.

In view of the foregoing disadvantages inherent in the known type game apparatuses now present in the prior art, the present invention provides an improved game apparatus, which will be described subsequently in great detail, is to provide a new and improved game apparatus which is not anticipated, rendered obvious, suggested, or even implied by the prior art, either alone or in any combination thereof.

To attain this, the present invention essentially comprises a plurality of sets of matching pieces, in which each piece within any given matching set has a geometric shape substantially matching all of the other pieces within the given matching set. Each piece also has an inside wall that defines a centrally disposed hole. Furthermore, each piece also has an sub-image embossed on at least one surface of each piece. Finally, each piece also has a logo marking marked on at least one surface of each piece. The method comprises the steps of obtaining, distributing, deciding, declaring, identifying, selecting, noting, determining, choosing, offering, accepting, attempting, winning, attaining, achieving, earning, getting, scoring, and transferring.

There has thus been outlined, rather broadly, the more important features of the invention in order that the detailed description thereof that follows may be better understood, and in order that the present contribution of the art may be better appreciated.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved game apparatus that has all the advantages of the prior art game apparatus and none of the disadvantages.

It is another object of the present invention to provide a new and improved game apparatus that may be easily and efficiently manufactured and marketed.

An even further object of the present invention is to provide a new and improved game apparatus that has a low cost of manufacture with regard to both materials and labor, and which accordingly is then susceptible of low prices of sale to the consuming public, thereby making such multi-purpose storage unit and system economically available to the buying public.

Still another object of the present invention is to provide a new game apparatus that provides in the apparatuses and methods of the prior art some of the advantages thererof, while simultaneously overcoming some of the disadvantages normally associated therewith.

Even still another object of the present invention is to provide a game apparatus having pieces with an indicia affixed on each piece, a sub-image embossed on each piece and a logo marking marked on each piece. This makes it possible to allow the users to play with the various pieces in a manner comprising the steps of obtaining, distributing, deciding, declaring, identifying, selecting, noting, determining, choosing, offering, accepting, attempting, winning, attaining, achieving, earning, getting, scoring, and transferring.

Lastly, it is an object of the present invention to provide a new and improved method of using the game apparatus in which the method comprises the steps of obtaining, distributing, deciding, declaring, identifying, selecting, noting, determining, choosing, offering, accepting, attempting, winning, attaining, achieving, earning, getting, scoring, and transferring.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a back side view of a preferred embodiment of the game apparatus of the present invention; and.

The same reference numerals refer to the same parts throughout the various figures.

DETAILED DESCRIPTION OF THE PREFERRED EMBODIMENT

Figure 1:
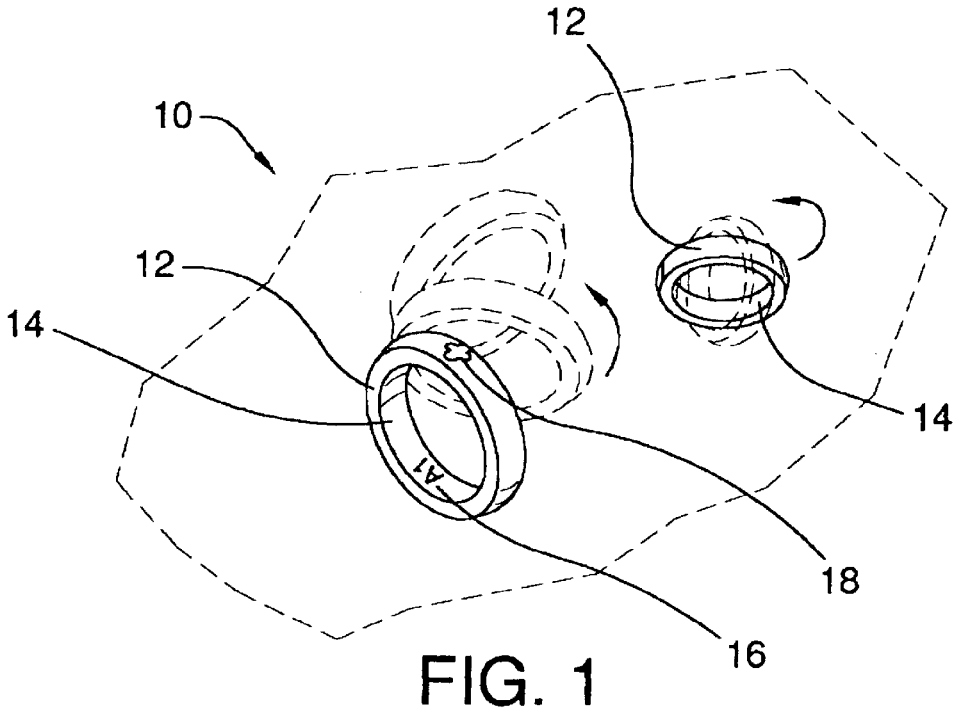
FIG. 1 is a perspective view of a preferred embodiment of the game apparatus constructed in accordance with the principles of the present invention.

Referring now to the drawings, and in particular FIGS. 1 to 5 thereof, one preferred embodiment of the present invention is shown and generally designated by the reference numeral 10. This preferred embodiment of the game apparatus 10 has a plurality of parts for use in betting and/or trading various parts of the game apparatus 10 between players, the game apparatus 10 comprising: a plurality of sets of matching pieces 12, each piece 12 within any given matching set having: a geometric shape substantially matching all of the other pieces 12 within the given matching set; an inside wall 14 defining a centrally disposed hole; an indicia 16 affixed on each piece 12; an sub-image 18 embossed on each piece 12; a logo marking 20 marked on each piece 12.

Another preferred embodiment of the game apparatus 10 comprises: a plurality of sets of matching pieces 12, each piece 12 within any given matching set having: a geometric shape substantially matching all of the other pieces 12 within the given matching set; an inside wall 14 defining a centrally disposed hole; an indicia 16 affixed on each piece, the indicia 16 affixed on each piece 12 comprising: a first component for indicating a particular corresponding matching set that the piece 12 is associated with the particular corresponding matching set; and a second component for indicating a hierarchal sequence number assigned to the piece 12 within the particular corresponding matching set; an sub-image 18 embossed on each piece 12; a logo marking 20 marked on each piece, wherein a first set of matching pieces 12 comprising an "A" set of matching pieces 12 including: a first "A" piece 12 having a ring geometric shape; an "A1" indicia 16 affixed on the inside wall 14 of the first "A" piece 12; a first "A" sub-image 18 embossed on the outside wall of the first "A" piece 12; and a "Z" logo marking 20 marked on the outside wall of the first "A" piece 12; a second "A" piece 12 configured in the ring geometric shape with an inside wall 14 defining a centrally disposed hole, wherein the external width of the ring geometric shape of the second "A" piece 12 is smaller than the external width of the ring geometric shape of the first "A" piece, the second "A" piece 12 having: an "A2" indicia 16 affixed on the inside wall 14 of the second "A" piece 12; a second "A" sub-image 18 embossed on the outside wall of the second "A" piece 12; and a "G" logo marking 20 marked on the outside wall of the second "A" piece 12; a third "A" piece 12 configured in the ring geometric shape with an inside wall 14 defining a centrally disposed hole, wherein the external width of the ring geometric shape of the third "A" piece 12 is smaller than the external width of the ring geometric shape of the second "A" piece, the third "A" piece 12 having: an "A3" indicia 16 affixed on the inside wall 14 of the third "A" piece 12; a third "A" sub-image 18 embossed on the outside wall of the third "A" piece 12; and a "N" logo marking 20 marked on the outside wall of the third "A" piece 12; a fourth "A" piece 12 configured in the ring geometric shape with an inside wall 14 defining a centrally disposed hole, wherein the external width of the ring geometric shape of the fourth "A" piece 12 is smaller than the external width of the ring geometric shape of the third "A" piece, the fourth "A" piece 12 having: an "A4" indicia 16 affixed on the inside wall 14 of the fourth "A" piece 12; a fourth "A" sub-image 18 embossed on the outside wall of the fourth "A" piece 12; and a "I" logo marking 20 marked on the outside wall of the fourth "A" piece 12; and a fifth "A" piece 12 configured in the ring geometric shape with an inside wall 14 defining a centrally disposed hole, the external width of the ring geometric shape of the fifth "A" piece 12 is smaller than the external width of the ring geometric shape of the fourth "A" piece 12; wherein the fifth "A" piece 12 having: an "A5" indicia 16 affixed on the inside wall 14 of the fifth "A" piece 12; a fifth "A" sub-image 18 embossed on the outside wall of the fifth "A" piece 12; and a "R" logo marking 20 marked on the outside wall of the fifth "A" piece 12.

One embodiment of the method of using a game apparatus 10 having a plurality of parts for use in betting and/or trading various parts of the game apparatus 10 between a first and a second player, the method of using the game apparatus 10 comprising the steps of: obtaining, distributing, deciding, declaring, identifying, selecting, noting, determining, choosing, offering, accepting, attempting, winning, attaining, achieving, earning, getting, scoring, and transferring. The obtaining step comprises obtaining the game apparatus 10 comprising: a plurality of sets of matching pieces 12, each piece 12 within any given matching set having: a geometric shape substantially matching all of the other pieces 12 within the given matching set; an inside wall 14 defining a centrally disposed hole; an indicia 16 affixed on each piece, wherein the indicia 16 affixed on each piece 12 comprising: a first component for indicating a particular corresponding matching set that the piece 12 is associated with the particular corresponding matching set; and a second component for indicating a hierarchal sequence number assigned to the piece 12 within the particular corresponding matching set; an sub-image 18 embossed on each piece 12; a logo marking 20 marked on each piece, wherein a first set of matching pieces 12 comprising: an "A" set of matching pieces 12 including: a first "A" piece 12 having a ring geometric shape; an "A1" indicia 16 affixed on the inside wall 14 of the first "A" piece 12; a first "A" sub-image 18 embossed on the outside wall of the first "A" piece 12; and a "Z" logo marking 20 marked on the outside wall of the first "A" piece 12; a second "A" piece 12 configured in the ring geometric shape with an inside wall 14 defining a centrally disposed hole, wherein the external width of the ring geometric shape of the second "A" piece 12 is smaller than the external width of the ring geometric shape of the first "A" piece, the second "A" piece 12 having: an "A2" indicia 16 affixed on the inside wall 14 of the second "A" piece 12; a second "A" sub-image 18 embossed on the outside wall of the second "A" piece 12; and a "G" logo marking 20 marked on the outside wall of the second "A" piece 12; a third "A" piece 12 configured in the ring geometric shape with an inside wall 14 defining a centrally disposed hole, wherein the external width of the ring geometric shape of the third "A" piece 12 is smaller than the external width of the ring geometric shape of the second "A" piece, the third "A" piece 12 having: an "A3" indicia 16 affixed on the inside wall 14 of the third "A" piece 12; a third "A" sub-image 18 embossed on the outside wall of the third "A" piece 12; and a "N" logo marking 20 marked on the outside wall of the third "A" piece 12; a fourth "A" piece 12 configured in the ring geometric shape with an inside wall 14 defining a centrally disposed hole, wherein the external width of the ring geometric shape of the fourth "A" piece 12 is smaller than the external width of the ring geometric shape of the third "A" piece, the fourth "A" piece 12 having: an "A4" indicia 16 affixed on the inside wall 14 of the fourth "A" piece 12; a fourth "A" sub-image 18 embossed on the outside wall of the fourth "A" piece 12; and a "I" logo marking 20 marked on the outside wall of the fourth "A" piece 12; and a fifth "A" piece 12 configured in the ring geometric shape with an inside wall 14 defining a centrally disposed hole, the external width of the ring geometric shape of the fifth "A" piece 12 is smaller than the external width of the ring geometric shape of the fourth "A" piece 12; wherein the fifth "A" piece 12 having: an "A5" indicia 16 affixed on the inside wall 14 of the fifth "A" piece 12; a fifth "A" sub-image 18 embossed on the outside wall of the fifth "A" piece 12; and a "R" logo marking 20 marked on the outside wall of the fifth "A" piece 12. The distributing step comprises distributing ownership of a first and second collection of various pieces 12 of the game apparatus 10 to the first and second player, respectively. The deciding step comprises deciding by the first player to declare that at least one of the pieces 12 owned by the first player is to be declared by the first player to be a first player betting piece 12. The declaring step comprises declaring by the first player to the second player that the first player betting piece 12 is a playing piece 12. The identifying step comprises identifying the second component of the indicia 16 affixed on the first player betting piece 12. The selecting step comprises selecting by the second player at least one of the pieces 12 owned by the second player to be a second player betting piece 12. The noting step comprises noting the second component of the indicia 16 affixed on the second player betting piece 12. The determining step comprises determining whether the second component of the indicia 16 affixed on the second player betting piece 12 is equal to or greater than the second component of the indicia 16 affixed on the first player betting piece 12. The choosing step comprises choosing by the second player to the first player a spin skill technique that is acceptable to both the first and second players. The offering step comprises offering a spin challenge to the first player by the second player to perform the spin skill technique when it is determined that the second component of the indicia 16 affixed on the second player betting piece 12 is equal to or greater than the second component of the indicia 16 affixed on the first player betting piece 12. The accepting step comprises accepting the spin challenge by the first player subsequent to when the second player offers the spin challenge to the first player. The attempting step comprises attempting during multiple rounds to perform the spin skill technique on the first player betting piece 12 by the first player and to perform the spin skill technique on the second player betting piece 12 by the second player. The winning step comprises winning any given round by the player who successfully performs the attempted spin skill technique on the betting piece 12 associated with that player when the other player is not successful in performing the attempted spin skill technique on the betting piece 12 associated with the other player. The attaining step comprises attaining an "R" score by the player who wins any given round. The achieving step comprises achieving an "I" score by the player who wins any given round when the player has already attained the "R" score. The earning step comprises earning an "N" score by the player who wins any given round when the player has already attained the "R" score and achieved the "I" score. The getting step comprises getting a "G" score by the player who wins any given round when the player has already attained the "R" score, achieved the "I" score and earned an "N" score. The scoring step comprises scoring a "Z" score by the player who wins any given round when the player has already attained the "R" score, achieved the "I" score, earned an "N" score and got the "G" score. The transferring step comprises transferring possession of the betting piece 12 played by the player who was not able to spell "R", "I", "N", "G", "Z" to the player who was able to spell "R", "I", "N", "G", "Z".

The indicia 16 affixed on each particular piece 12 of the game apparatus 10 may comprise any known type of marking used to indicate the set. One preferred configuration of the indicia 16 comprises: a first component for indicating a particular corresponding matching set that the particular piece 12 is associated with the particular corresponding matching set; and a second component for indicating a hierarchal sequence number assigned to the particular piece 12 within the particular corresponding matching set. One preferred configuration of the first component of the indicia 16 selected from the group consisting of A, B, C, D, E, F, G, H, I, J, K, L, M, N, O, P, Q, R, S, T, U, V, W, X, Y, and Z and the second component of the indicia 16 selected from the group consisting of "1", "2", "3", "4", and "5". One preferred location of where the indicia 16 is affixed on each piece 12 is on the inside wall 14 of each piece 12.

The sub-image 18 of the game apparatus 10 may be embossed on any area of each piece 12. One preferred location of where the sub-image 18 is that it is embossed on the outside wall of each piece 12. One preferred configuration of the sub-images 18 associated with any given matching set is that a composite image is discernable from the combination of the sub-images 18 of all of the pieces 12 associated with any given matching set when all of the pieces 12 associated with any given matching set are stacked together and ordered to correspond to the hierarchal sequence order of all of the pieces 12 associated with any given matching set. One preferred composite image 18 comprises a stylized skull and bones smoking a cigarette.

The geometric shapes of the pieces can be any geometric shape. The general geometric shape of the pieces may be selected from the group consisting of a circle, ellipse, triangle, square, rectangle, pentagon, hexagon, heptagon, and octagon. One preferred configuration of at least one set of matching pieces is that the set of matching pieces have a geometric shape shaped as a ring.

The relative size of each piece within any given set of matching pieces may be any size. One preferred configuration of the relative size of each piece 12 within a set of matching pieces 12 is that the relative external width of each piece 12 within a given matching set is proportional to the hierarchal sequence order. Another preferred configuration of the relative size of each piece 12 within a set of matching pieces 12 is that the relative external width of each piece 12 decreases as the hierarchal sequence order of each piece 12 within the given matching set increases. Yet another preferred configuration of the relative size of each piece 12 within a set of matching pieces 12 is that the relative external width of each piece 12 increases as the hierarchal sequence order of each piece 12 within the given matching set decreases.

The location and the meaning of the logo marking 20 may be any location on the pieces 12 and be of any type of marking available. One preferred configuration of the logo marking 20 is that it is marked on the outside wall of each piece, the logo marking 20 for indicating the name of the game apparatus 10. The logo marking 20 may be selected from the group consisting of A, B, C, D, E, F, G, H, I, J, K, L, M, N, O, P, Q, R, S, T, U, V, W, X, Y, and Z. One preferred configuration of the logo marking 20 is that it is selected from the group consisting of R, I, N, G, and Z.

The game apparatus 10 may be composed of any types of building materials, such as wood, plastic or metal. One preferred configuration of the material used to make up the matching set of pieces 12 is metal selected from the group consisting of iron, cobalt, copper, nickel, palladium, vanadium, titanium, molybdenum, tin, chrome, zinc, bronze, brass, silver, gold, platinum, and admixtures thereof.

The configuration of the first set of matching pieces 12 may comprise any number of different sizes, shapes, indicia 16, logo markings 20 and sub-images 18 on each piece 12 of the first set of matching pieces. One preferred configuration of the first set of matching pieces 12 may comprises an "A" set of matching pieces 12 including: a first "A" piece 12 having a ring geometric shape; an "A1" indicia 16 affixed on the inside wall 14 of the first "A" piece 12; a first "A" sub-image 18 embossed on the outside wall of the first "A" piece 12; and a "Z" logo marking 20 marked on the outside wall of the first "A" piece 12; a second "A" piece 12 configured in the ring geometric shape with an inside wall 14 defining a centrally disposed hole, wherein the external width of the ring geometric shape of the second "A" piece 12 is smaller than the external width of the ring geometric shape of the first "A" piece, the second "A" piece 12 having: an "A2" indicia 16 affixed on the inside wall 14 of the second "A" piece 12; a second "A" sub-image 18 embossed on the outside wall of the second "A" piece 12; and a "G" logo marking 20 marked on the outside wall of the second "A" piece 12; a third "A" piece 12 configured in the ring geometric shape with an inside wall 14 defining a centrally disposed hole, wherein the external width of the ring geometric shape of the third "A" piece 12 is smaller than the external width of the ring geometric shape of the second "A" piece, the third "A" piece 12 having: an "A3" indicia 16 affixed on the inside wall 14 of the third "A" piece 12; a third "A" sub-image 18 embossed on the outside wall of the third "A" piece 12; and a "N" logo marking 20 marked on the outside wall of the third "A" piece 12; a fourth "A" piece 12 configured in the ring geometric shape with an inside wall 14 defining a centrally disposed hole, wherein the external width of the ring geometric shape of the fourth "A" piece 12 is smaller than the external width of the ring geometric shape of the third "A" piece, the fourth "A" piece 12 having: an "A4" indicia 16 affixed on the inside wall 14 of the fourth "A" piece 12; a fourth "A" sub-image 18 embossed on the outside wall of the fourth "A" piece 12; and a "I" logo marking 20 marked on the outside wall of the fourth "A" piece 12; and a fifth "A" piece 12 configured in the ring geometric shape with an inside wall 14 defining a centrally disposed hole, the external width of the ring geometric shape of the fifth "A" piece 12 is smaller than the external width of the ring geometric shape of the fourth "A" piece 12; wherein the fifth "A" piece 12 having: an "A5" indicia 16 affixed on the inside wall 14 of the fifth "A" piece 12; a fifth "A" sub-image 18 embossed on the outside wall of the fifth "A" piece 12; and a "R" logo marking 20 marked on the outside wall of the fifth "A" piece 12.

Referring now to FIG. 1, which depicts a perspective view of a preferred embodiment of the game apparatus 10 comprises a plurality of sets of matching pieces 12. In this embodiment the pieces 12 are shaped as rings having the indicia 16 affixed on the inside wall of each piece 12 and a sub-image 18 embossed on the outside wall of each piece 12. The pieces 12 may be spun on any available hard surface to be a spin skill technique.

Figure 2:
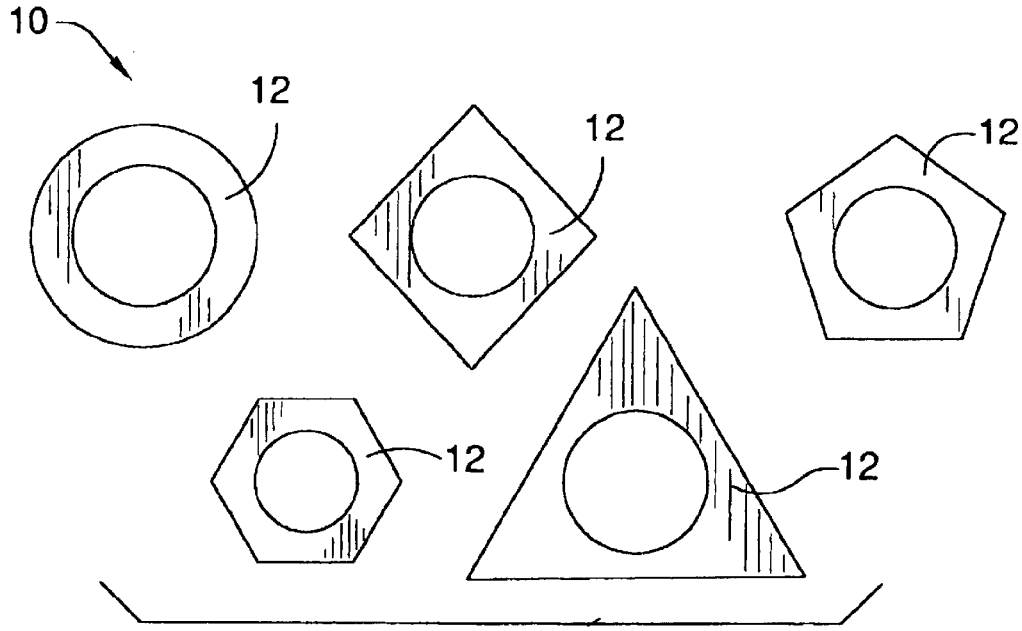
FIG. 2 is a top view of a preferred embodiment of the game apparatus of the present invention.

Referring now to FIG. 2, which depicts a top view of another preferred embodiment of the game apparatus 10 that illustrates that different sets of matching pieces may comprise the general geometric shapes comprise a circle, square, pentagonal, hexagonal and trigonal shapes.

Figure 3:
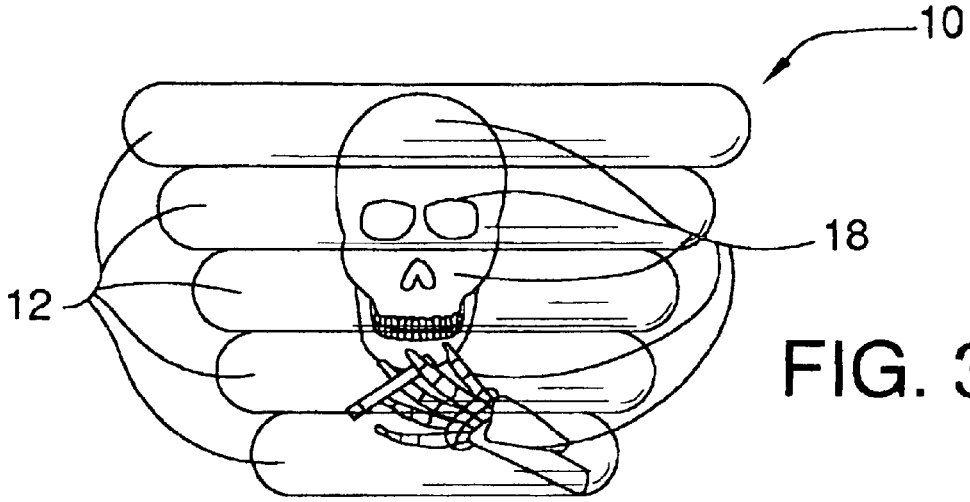
FIG. 3 is a front side view of a preferred embodiment of the game apparatus of the present invention.

Referring now to FIG. 3, which depicts a front side view of a preferred embodiment of the game apparatus 10 illustrates that a composite image is discernable from the combination of the sub-images of all of the pieces associated within the matching set when the pieces are stacked together.

The composite image may comprise any image, such as a stylized skull and bones image smoking a cigarette.

Figure 4:
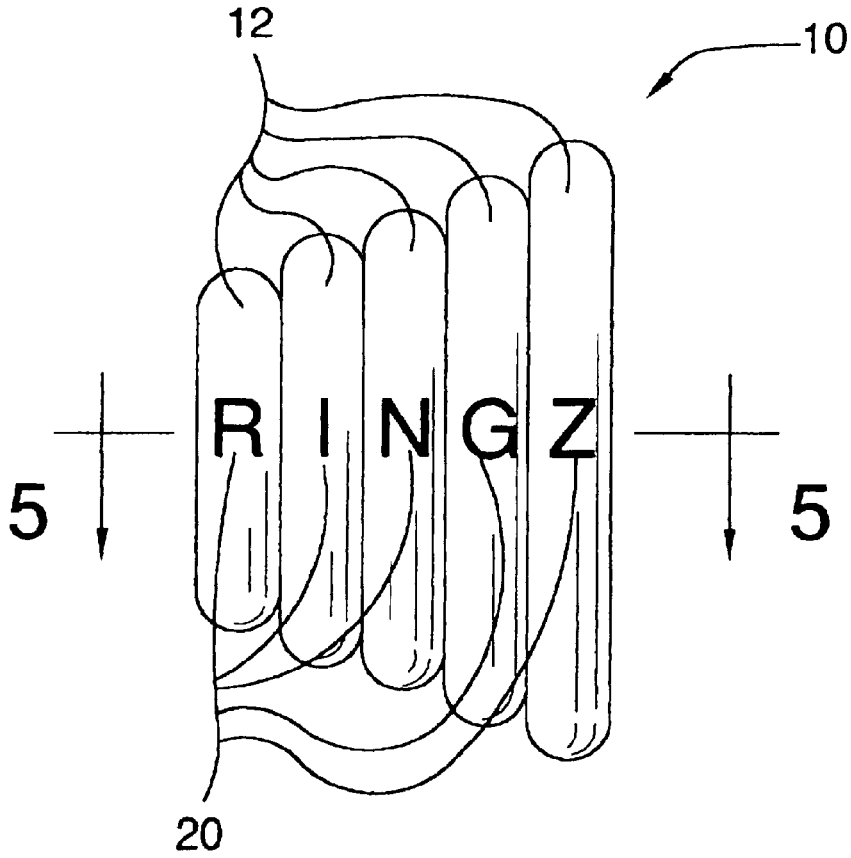

Referring now to FIG. 4, which depicts a back side view of a preferred embodiment of the game apparatus 10 that shows the combination of logo markings marked on each piece of a set of matching sets may also be used to form a combinational logo marking. The combination logo marking may comprise any name, such as the name "RINGZ".

Figure 5:
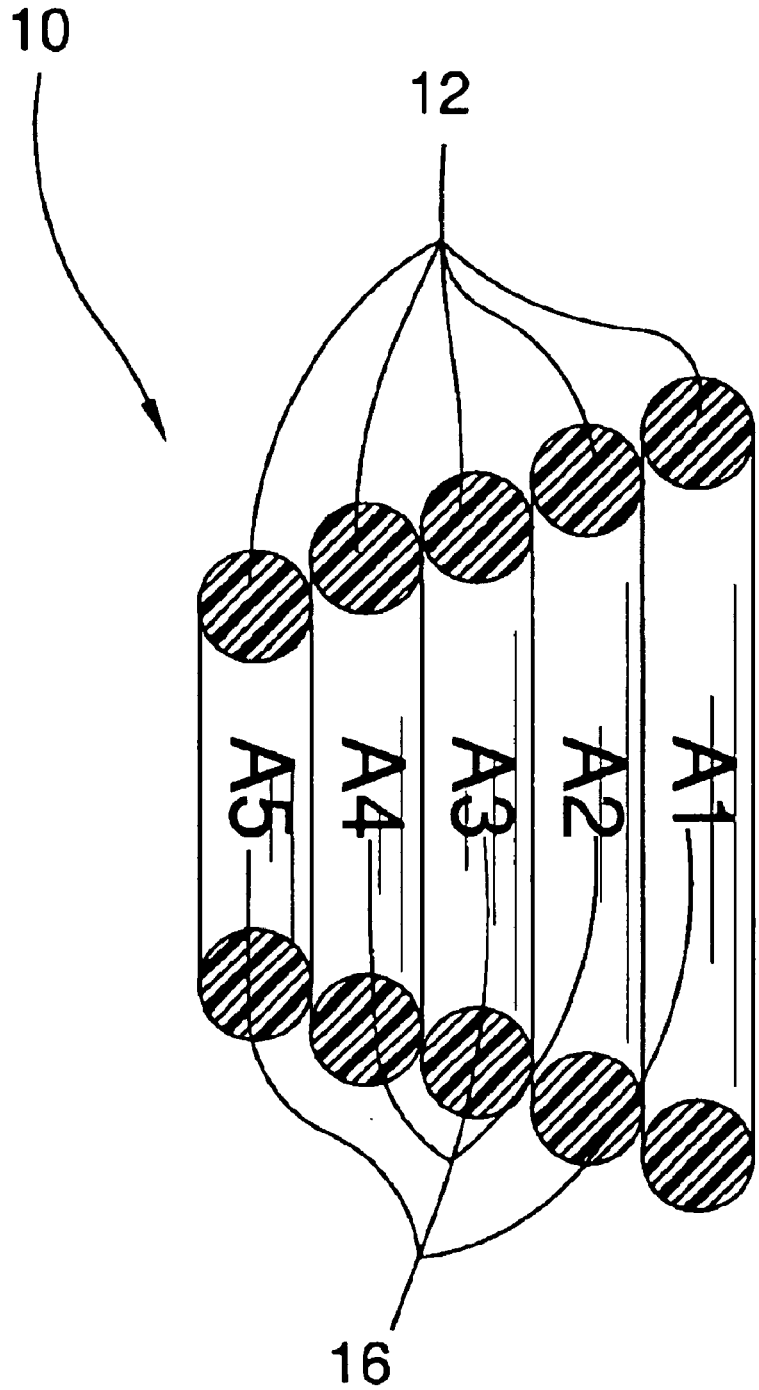
FIG. 5 is a cross sectional view of a preferred embodiment of the game apparatus of the present invention.

Referring now to FIG. 5, which depicts a cross sectional view of a preferred embodiment of the game apparatus 10 showing the indicia affixed on the inside surface of each piece of a set of matching pieces. Here the indicia indicate the "A" set of matching pieces and the numerical component of the indicia indicate the hierarchically assigned sequence number associated with each piece 12 in the set of matching pieces 12.

As to the manner of usage and operation of the present invention, the same should be apparent from the above description. Accordingly, no further discussion relating to the manner of usage and operation will be provided.

While a preferred embodiment of the game apparatus has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A game apparatus having a plurality of parts for use in betting and/or trading various parts of said game apparatus between players, said game apparatus comprising:

a plurality of sets of matching pieces, each piece within any given matching set having:

a geometric shape substantially matching all of the other pieces within the given matching set;

an inside wall defining a centrally disposed hole;

an indicia affixed on each piece;

an sub-image embossed on each piece; and a logo marking marked on each piece;

wherein a first set of matching pieces comprises an "A" set of matching pieces including:

a first "A" piece having a ring geometric shape;

an "A1" indicia affixed on the inside wall of said first "A" piece;

a first "A" sub-image embossed on the outside wall of said first "A" piece; and a "Z" logo marking marked on the outside wall of the first "A" piece;

a second "A" piece configured in the ring geometric shape with an inside wall defining a centrally disposed hole, wherein the external width of the ring geometric shape of said second "A" piece is smaller than the external width of the ring geometric shape of said first "A" piece, said second "A" piece having:

an "A2" indicia affixed on the inside wall of said second "A" piece;

a second "A" sub-image embossed on the outside wall of said second "A" piece; and a "G" logo marking marked on the outside wall of said second "A" piece;

a third "A" piece configured in the ring geometric shape with an inside wall defining a centrally disposed hole, wherein the external width of the ring geometric shape of said third "A" piece is smaller than the external width of the ring geometric shape of said second "A" piece, said third "A" piece having:

an "A3" indicia affixed on the inside wall of said third "A" piece;

a third "A" sub-image embossed on the outside wall of said third "A" piece; and a "N" logo marking marked on the outside wall of said third "A" piece;

a fourth "A" piece configured in the ring geometric shape with an inside wall defining a centrally disposed hole, wherein the external width of the ring geometric shape of said fourth "A" piece is smaller than the external width of the ring geometric shape of said third "A" piece, said fourth "A" piece having:

an "A4" indicia affixed on the inside wall of said fourth "A" piece;

a fourth "A" sub-image embossed on the outside wall of said fourth "A" piece; and a "I" logo marking marked on the outside wall of said fourth "A" piece; and a fifth "A" piece configured in the ring geometric shape with an inside wall defining a centrally disposed hole, the external width of the ring geometric shape of said fifth "A" piece is smaller than the external width of the ring geometric shape of said fourth "A" piece; wherein said fifth "A" piece having:

an "A5" indicia affixed on the inside wall of said fifth "A" piece;

a fifth "A" sub-image embossed on the outside wall of said fifth "A" piece; and a "R" logo marking marked on the outside wall of said fifth "A" piece.

2. A game apparatus having a plurality of parts for use in betting and/or trading various parts of said game apparatus between players, said game apparatus comprising:

a plurality of sets of matching pieces, each piece within any given matching set having:

a geometric shape substantially matching all of the other pieces within the given matching set;

an inside wall defining a centrally disposed hole;

an indicia affixed on each piece, said indicia affixed on each piece comprising: a first component for indicating a particular corresponding matching set that the piece is associated with the particular corresponding matching set; and a second component for indicating a hierarchal sequence number assigned to the piece within the particular corresponding matching set;

an sub-image embossed on each piece;

a logo marking marked on each piece, wherein a first set of matching pieces comprising an "A" set of matching pieces including: a first "A" piece having a ring geometric shape; an "A1" indicia affixed on the inside wall of said first "A" piece; a first "A" sub-image embossed on the outside wall of said first "A" piece; and a "Z" logo marking marked on the outside wall of the first "A" piece;

a second "A" piece configured in the ring geometric shape with an inside wall defining a centrally disposed hole, wherein the external width of the ring geometric shape of said second "A" piece is smaller than the external width of the ring geometric shape of said first "A" piece, said second "A" piece having: an "A2" indicia affixed an the inside wall of said second "A" piece; a second "A" sub-image embossed on the outside wall of said second "A" piece; and a "G" logo marking marked on the outside wall of said second "A" piece;

a third "A" piece configured in the ring geometric shape with an inside wall defining a centrally disposed hole, wherein the external width of the ring geometric shape of said third "A" piece is smaller than the external width of the ring geometric shape of said second "A" piece, said third "A" piece having: an "A3" indicia affixed on the inside wall of said third "A" piece; a third "A" sub-image embossed on the outside wall of said third "A" piece; and a "N" logo marking marked on the outside wall of said third "A" piece;

a fourth "A" piece configured in the ring geometric shape with an inside wall defining a centrally disposed hole, wherein the external width of the ring geometric shape of said fourth "A" piece is smaller than the external width of the ring geometric shape of said third "A" piece, said fourth "A" piece having: an "A4" indicia affixed on the inside wall of said fourth "A" piece; a fourth "A" sub-image embossed on the outside wall of said fourth "A" piece; and a "I" logo marking marked on the outside wall of said fourth "A" piece; and a fifth "A" piece configured in the ring geometric shape with an inside wall defining a centrally disposed hole, the external width of the ring geometric shape of said fifth "A" piece is smaller than the external width of the ring geometric shape of said fourth "A" piece; wherein said fifth "A" piece having: an "A5" indicia affixed on the inside wall of said fifth "A" piece; a fifth "A" sub-image embossed on the outside wall of said fifth "A" piece; and a "R" logo marking marked on the outside wall of said fifth "A" piece.

3. A method of using a game apparatus having a plurality of parts for use in betting and/or trading various parts of the game apparatus between a first and a second player, said method of using the game apparatus comprising the steps of:

obtaining the game apparatus comprising:

a plurality of sets of matching pieces, each piece within any given matching set having:

a geometric shape substantially matching all of the other pieces within the given matching set;

an inside wall defining a centrally disposed hole;

an indicia affixed on each piece, wherein the indicia affixed on each piece comprising: a first component for indicating a particular corresponding matching set that the piece is associated with the particular corresponding matching set; and a second component for indicating a hierarchal sequence number assigned to the piece within the particular corresponding matching set;

an sub-image embossed on each piece;

a logo marking marked on each piece, wherein a first set of matching pieces comprising:

an "A" set of matching pieces including: a first "A" piece having a ring geometric shape; an "A1" indicia affixed on the inside wall of the first "A" piece; a first "A" sub-image embossed on the outside wall of the first "A" piece; and a "Z" logo marking marked on the outside wall of the first "A" piece;

a second "A" piece configured in the ring geometric shape with an inside wall defining a centrally disposed hole, wherein the external width of the ring geometric shape of the second "A" piece is smaller than the external width of the ring geometric shape of the first "A" piece, the second "A" piece having: an "A2" indicia affixed on the inside wall of the second "A" piece; a second "A" sub-image embossed on the outside wall of the second "A" piece; and a "G" logo marking marked on the outside wall of the second "A" piece;

a third "A" piece configured in the ring geometric shape with an inside wall defining a centrally disposed hole, wherein the external width of the ring geometric shape of the third "A" piece is smaller than the external width of the ring geometric shape of the second "A" piece, the third "A" piece having: an "A3" indicia affixed on the inside wall of the third "A" piece; a third "A" sub-image embossed on the outside wall of the third "A" piece; and a "N" logo marking marked on the outside wall of the third "A" piece;

a fourth "A" piece configured in the ring geometric shape with an inside wall defining a centrally disposed hole, wherein the external width of the ring geometric shape of the fourth "A" piece is smaller than the external width of the ring geometric shape of the third "A" piece, the fourth "A" piece having: an "A4" indicia affixed on the inside wall of the fourth "A" piece; a fourth "A" sub-image embossed on the outside wall of the fourth "A" piece; and a "I" logo marking marked on the outside wall of the fourth "A" piece; and a fifth "A" piece configured in the ring geometric shape with an inside wall defining a centrally disposed hole, the external width of the ring geometric shape of the fifth "A" piece is smaller than the external width of the ring geometric shape of the fourth "A" piece; wherein the fifth "A" piece having: an "A5" indicia affixed on the inside wall of the fifth "A" piece; a fifth "A" sub-image embossed on the outside wall of the fifth "A" piece; and a "R" logo marking marked on the outside wall of the fifth "A" piece;

distributing ownership of a first and second collection of various pieces of the game apparatus to the first and second player, respectively;

deciding by the first player to declare that at least one of the pieces owned by the first player is to be declared by the first player to be a first player betting piece;

declaring by the first player to the second player that the first player betting piece is a playing piece;

identifying the second component of the indicia affixed on the first player betting piece;

selecting by the second player at least one of the pieces owned by the second player to be a second player betting piece;

noting the second component of the indicia affixed on the second player betting piece;

determining whether the second component of the indicia affixed on the second player betting piece is equal to or greater than the second component of the indicia affixed on the first player betting piece;

choosing by the second player to the first player a spin skill technique that is acceptable to both the first and second players;

offering a spin challenge to the first player by the second player to perform the spin skill technique when it is determined that the second component of the indicia affixed on the second player betting piece is equal to or greater than the second component of the indicia affixed on the first player betting piece;

accepting the spin challenge by the first player subsequent to when the second player offers the spin challenge to the first player;

attempting during multiple rounds to perform the spin skill technique on the first player betting piece by the first player and to perform the spin skill technique on the second player betting piece by the second player;

winning any given round by the player who successfully performs the attempted spin skill technique on the betting piece associated with that player when the other player is not successful in performing the attempted spin skill technique on the betting piece associated with the other player;

attaining an "R" score by the player who wins any given round;

achieving an "I" score by the player who wins any given round when the player has already attained the "R" score;

earning an "N" score by the player who wins any given round when the player has already attained the "R" score and achieved the "I" score;

getting a "G" score by the player who wins any given round when the player has already attained the "R" score, achieved the "I" score and earned an "N" score;

scoring a "Z" score by the player who wins any given round when the player has already attained the "R" score, achieved the "I" score, earned an "N" score and got the "G" score; and transferring possession of the betting piece played by the player who was not able to spell "R", "I", "N", "G", "Z" to the player who was able to spell "R", "I", "N", "G", "Z".

* * * * *